US006036620A

United States Patent [19]

Yang

[11] Patent Number: 6,036,620

[45] Date of Patent: Mar. 14, 2000

[54] TRAMPOLINE HAVING A JUMPING BED WITH ELASTIC STRAPS FOR SUPPORTING THE SAME ON A TRAMPOLINE FRAME

[76] Inventor: Yen-Shuo Yang, 2F-3, No. 3, Wu-Chang S. St., Pei Dist., Taichung City, Taiwan

[21] Appl. No.: 09/287,689

[22] Filed: Apr. 6, 1999

[51] Int. Cl.[7] ..... A63B 5/08

[52] U.S. Cl. ..... 482/27; 482/28

[58] Field of Search ..... 482/27, 28; 5/111, 5/110; 52/99.1, 100

[56] References Cited

U.S. PATENT DOCUMENTS

| | | | |
|---|---|---|---|
| 2,991,841 | 7/1961 | Sampson et al. | 482/27 |
| 4,284,271 | 8/1981 | Pettit et al. | 482/27 |
| 4,331,329 | 5/1982 | Mirkovich | 482/27 |
| 4,386,772 | 6/1983 | Wu | 482/28 |

FOREIGN PATENT DOCUMENTS

| | | | |
|---|---|---|---|
| X 256293 | 12/1964 | Australia | 482/27 |
| 2657528 | 8/1991 | France | 482/27 |

*Primary Examiner*—Jerome Donnelly
*Attorney, Agent, or Firm*—Brinks Hofer Gilson & Lione

[57] ABSTRACT

A trampoline includes a trampoline frame and a jumping bed. The trampoline frame includes a leg portion disposed uprightly on a ground surface, and a looped frame portion mounted on top of the leg portion so as to be supported spacedly from and parallel to the ground surface. The looped frame portion confines a bed mounting space therewithin. The jumping bed includes a bed member with a peripheral portion and of a dimension smaller than that of the bed mounting space, and an elastic support unit having a plurality of folded elastic straps. Each of the elastic straps has opposite ends secured to the peripheral portion of the bed member and confines a passage for extension of the looped frame portion therethrough, thereby suspending elastically the bed member relative to the looped frame portion.

3 Claims, 5 Drawing Sheets

TRAMPOLINE HAVING A JUMPING BED WITH ELASTIC STRAPS FOR SUPPORTING THE SAME ON A TRAMPOLINE FRAME

FIELD OF THE INVENTION

The invention relates to a trampoline, more particularly to a trampoline having a jumping bed with elastic straps for supporting the same on a trampoline frame.

BACKGROUND OF THE INVENTION

Referring to FIGS. 1 and 2, a conventional trampoline includes a trampoline frame 10, a jumping bed 11, and a plurality of coil springs 12.

As illustrated, the trampoline frame 10 includes a leg portion having a plurality of upright leg 101 adapted to be disposed uprightly on a ground surface, and a looped frame portion 103 mounted on top of the legs 101 so as to be supported spacedly from and parallel to the ground surface. The looped frame portion 103 confines a bed mounting space 104 therewithin.

The jumping bed 11 includes a bed member 111 with a peripheral portion 112 and of a dimension smaller than that of the bed mounting space 104. Each of the coil springs 12 has an inner end 121 hooked on the peripheral portion 112 of the bed member 111, and an outer end 122 hooked on the looped frame portion 103, thereby suspending resiliently the bed member 111 relative to the looped frame portion 103.

In order to prevent the jumper's feet from slipping into a clearance 106 formed between an adjacent pair of the springs 12 and between the peripheral portion 112 of the bed member 111 and the looped frame portion 103, an annular protective covering 14 (see FIG. 2) is disposed on the looped frame portion 103 so as to cover the clearances 106. The protective covering 14 has an anchoring portion 140 engaging the looped frame 10 portion 103 and an inner covering portion 141 that extends radially and inwardly from the anchoring portion 140 so as to be disposed above and cover the clearances 106.

A disadvantage that results from the use of the conventional trampoline is that, the inner covering portion 141 of the protective covering 14 will separate from the bed member 111 during a jumping operation on the latter due to the lack of a securing mechanism therebetween, thereby resulting in a clearance between the inner covering portion 141 and the bed member 111 via which the jumper's feet can drop thereinto and thus lead to possible injury due to contact with the ends 121 of the springs 12.

SUMMARY OF THE INVENTION

Therefore, the object of this invention is to provide a trampoline having a jumping bed with elastic straps for supporting the same on a trampoline frame and which is capable of overcoming the aforesaid disadvantage that generally results from the use of the conventional trampoline.

Accordingly, a trampoline of this invention includes a trampoline frame and a jumping bed. The trampoline frame includes a leg portion disposed uprightly on a ground surface, and a looped frame portion mounted on top of the leg portion so as to be supported spacedly from and parallel to the ground surface. The looped frame portion confines a bed mounting space therewithin. The jumping bed includes a bed member with a peripheral portion and of a dimension smaller than that of the bed mounting space, and an elastic support unit which has a plurality of folded elastic straps. Each of the elastic straps has opposite ends secured to the peripheral portion of the bed member, and confines a passage for extension of the looped frame portion therethrough, thereby suspending elastically the bed member relative to the looped frame portion.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
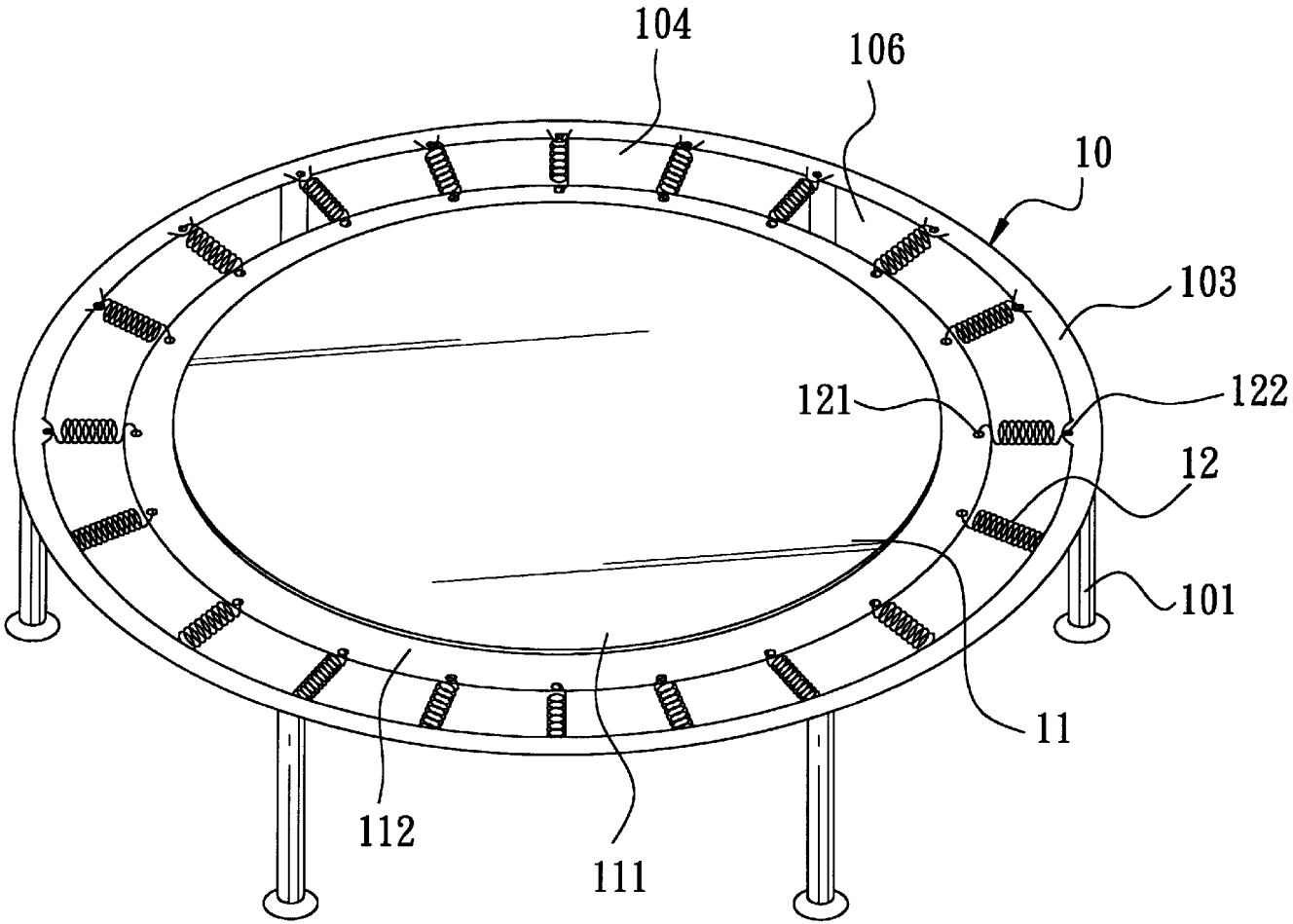
FIG. 1 PRIOR ART
FIG. 1 is a perspective view of a conventional trampoline in which a protective covering is removed for the sake of clarity.
Figure 2:
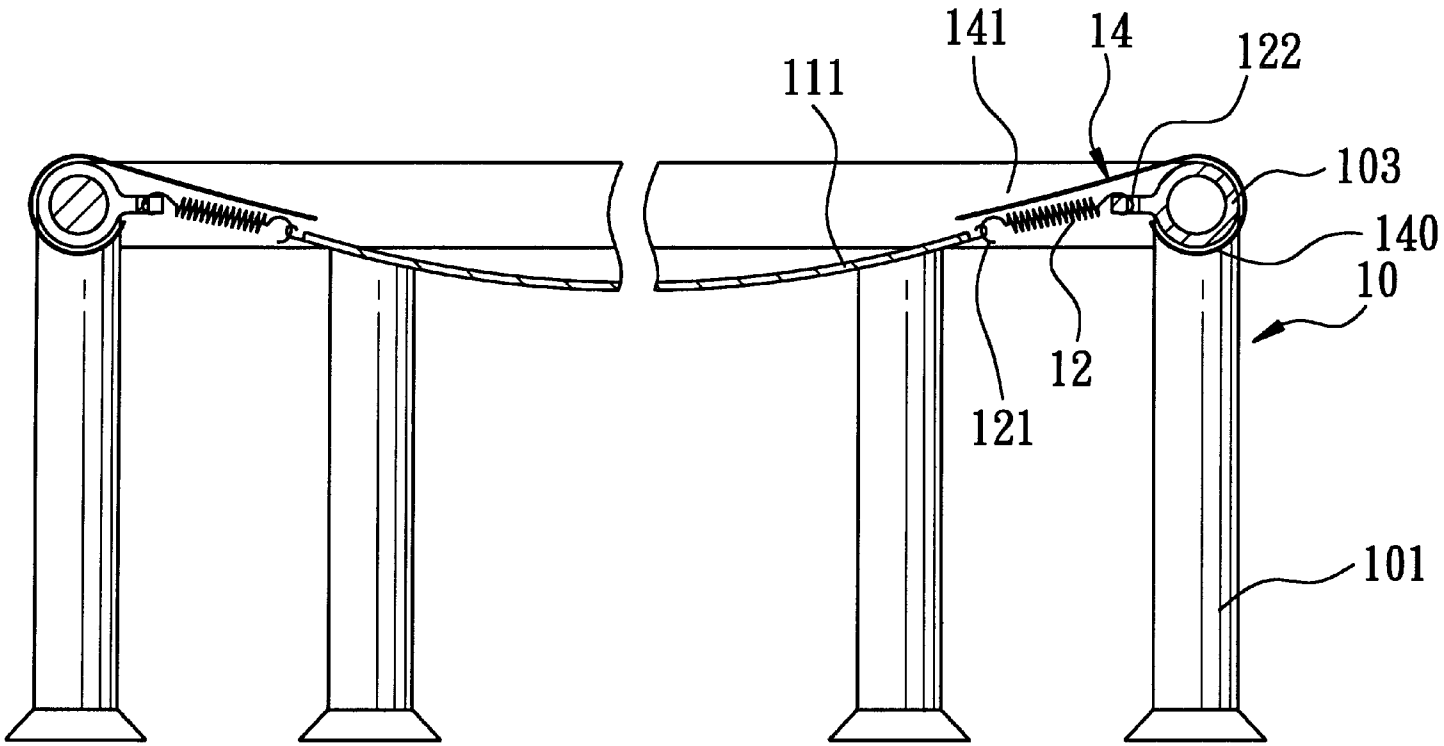
FIG. 2 PRIOR ART
FIG. 2 is a partly sectional view of the conventional trampoline.
Figure 3:
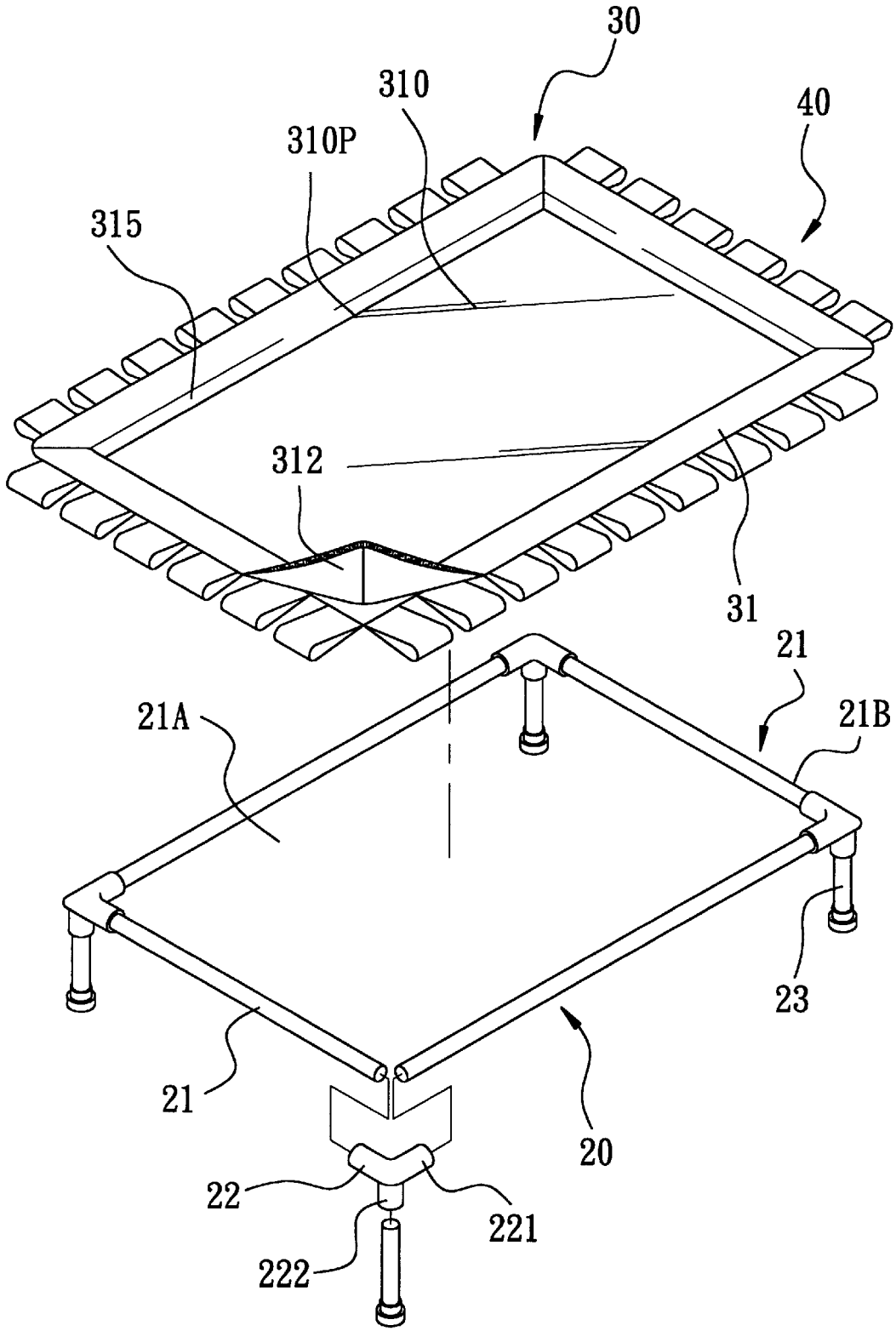
FIG. 3 is a partly exploded view of a preferred embodiment of a trampoline according to this invention.
Figure 4:
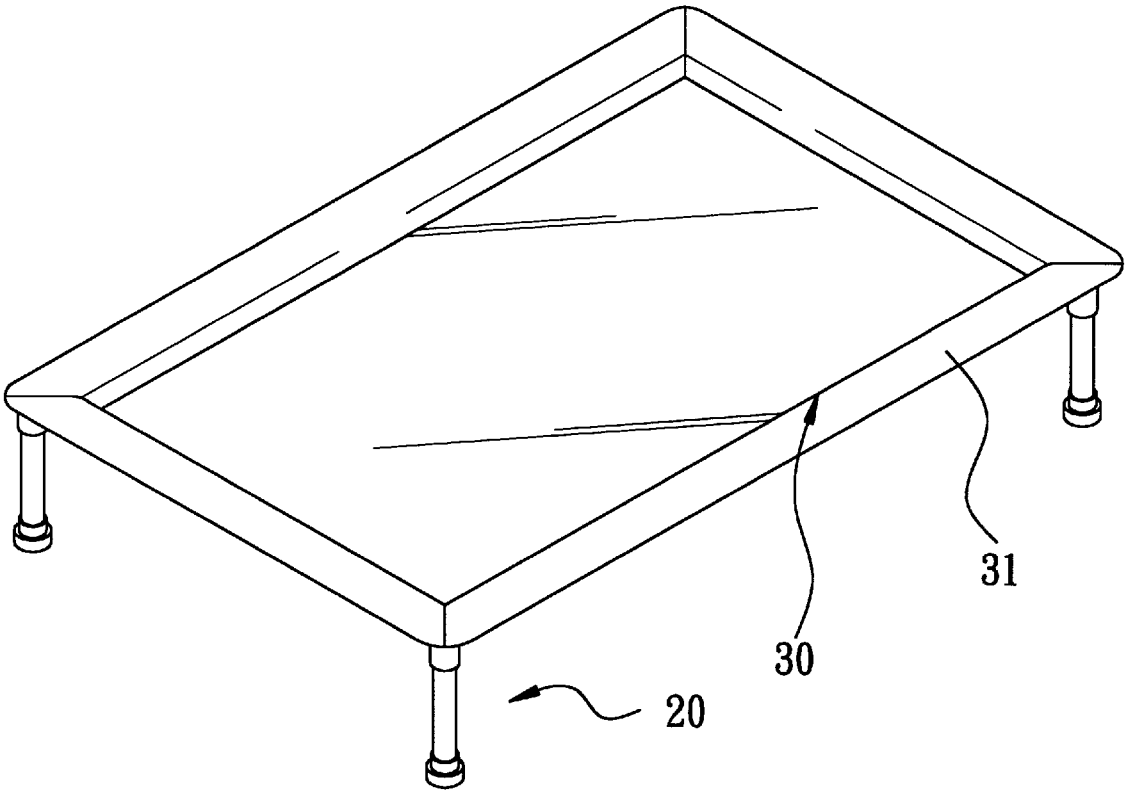
FIG. 4 is an assembled perspective view of the preferred embodiment.
Figure 5:
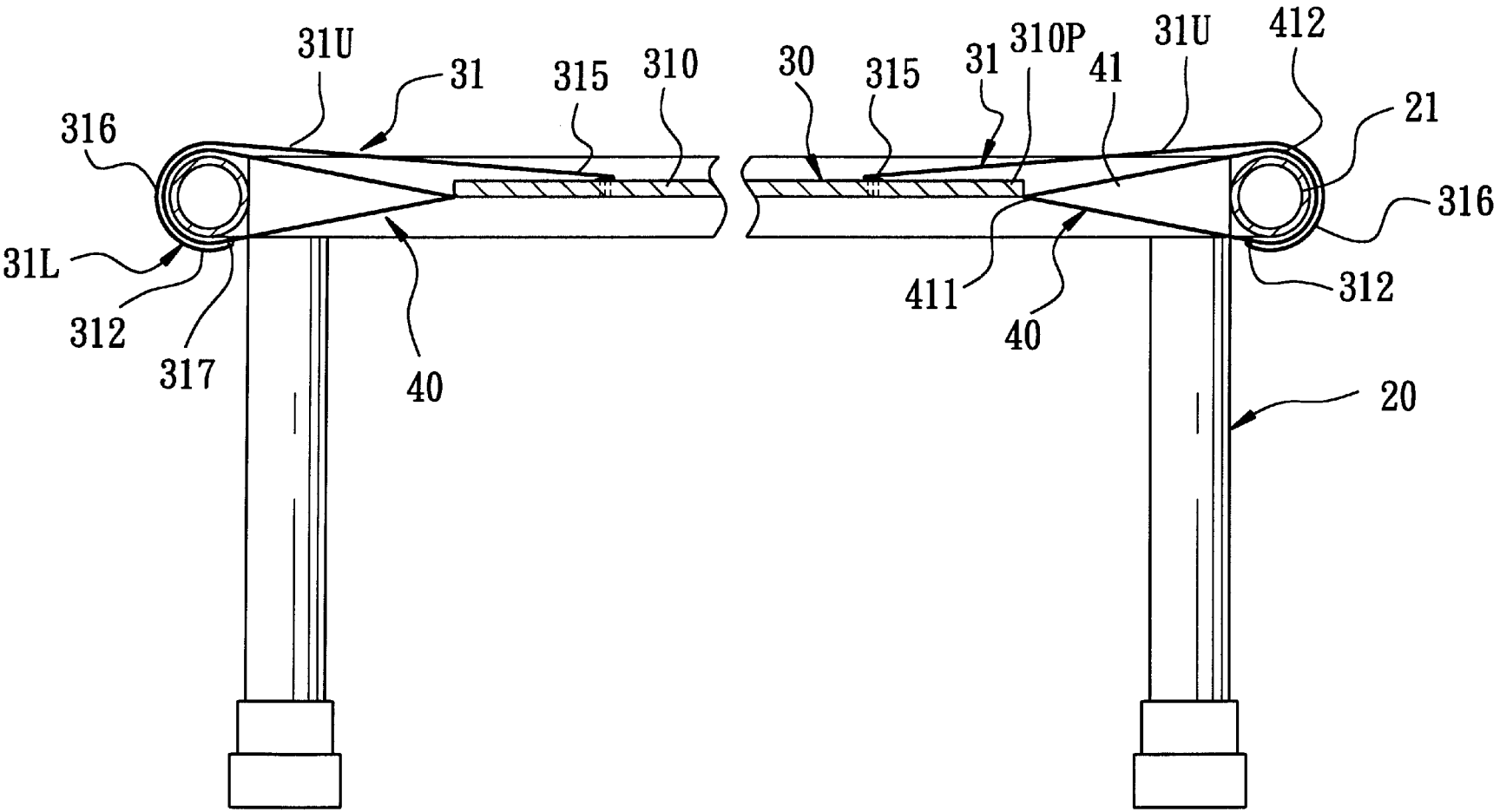
FIG. 5 is a partly sectional view of the preferred embodiment.

Referring to FIGS. 3, 4 and 5, the preferred embodiment of a trampoline 20 according to the present invention is shown to include a trampoline frame 20 and a jumping bed 30.

As illustrated, the trampoline frame 20 includes a leg portion having a plurality of legs 23 adapted to be disposed uprightly on a ground surface, and a looped frame portion 21 mounted on top of the legs 23 so as to be supported spacedly from and parallel to the ground surface. The looped frame portion 21 confines a bed mounting space 21A therwithin.

The jumping bed 30 includes a bed member 310 with a peripheral portion 310P and of a dimension smaller than that of the bed mounting space 21A. The jumping bed 30 further includes an elastic support unit 40 having a plurality of folded elastic straps 41. Each of the elastic straps 41 has opposite ends 411 secured to the peripheral portion 310P of the bed member 310, and confines a passage 412 for extension of the looped frame portion 21 therethrough. Thus, the bed member 310 is suspended elastically relative to the looped frame portion 21.

The jumping bed 30 further includes a looped protective covering 31 which has an upper covering portion (31U) with an inner peripheral section 315 secured to an upper surface of the peripheral portion (310P) of the bed member 310, such as by sewing, and an outer peripheral section 316 that extends above the looped frame portion 21 so as to be disposed outwardly and laterally of the looped frame portion 21, and a lower covering portion (31L) that extends from the outer peripheral section 316 of the upper covering portion (31U) and that has an inner peripheral section 317 extending below the looped frame portion 21 so as to be disposed inwardly and laterally of the looped frame portion 21. An elastic band 312 is secured on the inner peripheral section 317 of the lower covering portion (31L) such that the inner peripheral section 317 of the lower covering portion (31L) is anchored elastically on the looped frame portion 21. Preferably, the protective covering 31 is made of a flexible material. Each of the looped frame portion 21 and the bed member 310 is rectangular in shape. The elastic straps 41 are arranged spacedly on four sides of the bed member 310.

Referring again to FIG. 3, the looped frame portion 21 includes four elongated frame sections 21B and four threeway connectors 22. Each of the connectors 22 has two lateral portions 221 inserted by adjoining ends of an adjacent pair of the frame sections 21B, and a downwardly extending portion 222 that defines a socket hole for insertion of the top end of a respective one of the legs 23.

Since elastic straps 41 are used instead of coil springs to suspend the bed member 310 relative to the looped frame portion 21, and since the protective covering 31 is secured to the bed member 310 and shields the clearances formed between adjacent ones of the folded elastic straps 41, the disadvantage that results from the use of the conventional trampoline can be avoided.

With this invention thus explained, it is apparent that numerous modifications and variations can be made without departing from the scope and spirit of this invention. It is therefore intended that this invention be limited only as indicated in the appended claims.

I claim:

1. A trampoline comprising:

a trampoline frame including a leg portion adapted to be disposed uprightly on a ground surface, and a looped frame portion mounted on top of said leg portion so as to be supported spacedly from and parallel to the ground surface, said looped frame portion confining a bed mounting space therewithin;

a jumping bed including a bed member with a peripheral portion and of a dimension smaller than that of said bed mounting space, said jumping bed further including an elastic support unit having a plurality of folded elastic straps, each of said elastic straps having opposite ends secured to said peripheral portion of said bed member and confining a passage for extension of said looped frame portion therethrough, thereby suspending elastically said bed member relative to said looped frame portion; and a looped protective covering having an upper covering portion with an inner peripheral section secured to an upper surface of said peripheral portion of said bed member, and an outer peripheral section that extends above said looped frame portion so as to be disposed outwardly and laterally of said looped frame portion, a lower covering portion that extends from said outer peripheral section of said upper covering portion and that has an inner peripheral section extending below said looped frame portion, and an elastic band secured on said inner peripheral section of said lower covering portion such that said inner peripheral section of said lower covering portion is anchored elastically on said looped frame portion.

2. The trampoline as defined in claim 1, wherein said protective covering is made of a flexible material.

3. The trampoline as defined in claim 1, wherein each of said looped frame portions and said bed member is rectangular in shape, said elastic straps being arranged spacedly on four sides of said bed member.

* * * * *